US007121916B2

(12) United States Patent
Suimon et al.

(10) Patent No.: US 7,121,916 B2
(45) Date of Patent: Oct. 17, 2006

(54) RUNNING TOY

(75) Inventors: Yoshio Suimon, Tokyo (JP); Kenji Nakayama, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 11/104,525

(22) Filed: Apr. 13, 2005

(65) Prior Publication Data

US 2006/0079152 A1 Apr. 13, 2006

(30) Foreign Application Priority Data

Oct. 13, 2004 (JP) ..... 2004-299102

(51) Int. Cl.
*A63H 17/26* (2006.01)
*A63H 17/36* (2006.01)

(52) U.S. Cl. ..... 446/469; 446/460; 446/468

(58) Field of Classification Search ..... 446/431, 446/448, 449, 454, 269, 460, 429, 466, 468, 446/456, 469, 462; 280/121.171, 121.145, 280/121.179, 121.102, 755, 124.171, 124.145, 280/124.179, 124.102
See application file for complete search history.

(56) References Cited

U.S. PATENT DOCUMENTS 2,913,253 A * 11/1959 Taber ..... 280/124.102
3,859,752 A * 1/1975 Morrison et al. ..... 446/6
5,265,902 A * 11/1993 Lewis ..... 280/124.102
5,306,038 A * 4/1994 Henderson, Jr. ..... 446/466
5,338,246 A * 8/1994 Suto ..... 446/466
6,599,169 B1 * 7/2003 Edmisson et al. ..... 446/466
6,604,982 B1 * 8/2003 Croteau-Brooks ..... 446/466
2003/0003843 A1 1/2003 Edmisson et al.

FOREIGN PATENT DOCUMENTS

DE 94 14 039 10/1994
JP 62-275488 11/1987
JP 2001-353379 12/2001

OTHER PUBLICATIONS

European Search Report dated Jan. 26, 2006 issued in corresponding European Patent Application No. 05102739.3-2318.

* cited by examiner

*Primary Examiner*—Eugene Kim
*Assistant Examiner*—Alyssa M. Lowen
(74) *Attorney, Agent, or Firm*—Staas & Halsey LLP

(57) ABSTRACT

A running toy having: a pair of right and left wheel supports to rotatably support right and left wheels, respectively; a pair of right and left rotation support portions to rotatably support the right and left wheel supports around an axis line along a back and forth direction as a center, respectively, the right and left rotation support portions being provided on both right and left side portions of a vehicle body, respectively; and a buffer to apply an elastic force to a portion of each of the wheel supports which is above the axis line of the rotation support portion, in a direction to react to the vehicle body, wherein each of the wheel supports supports the wheel on an outside of the axis line of the rotation support portion.

11 Claims, 11 Drawing Sheets

RUNNING TOY

BACKGROUND OF THE INVENTION

1. Field of the Invention

The present invention relates to a running toy comprising a shock-absorbing structure of a wheel.

2. Description of the Related Art

The conventional running toy comprises a pair of suspension arms which extend in the right and left direction of the vehicle body and support right and left running wheels at the tip portions thereof to be swingable in up and down direction, right and left dampers each having a coil spring which is extendable in the up and down direction and coupled to the suspension arm at the lower end portion, and an intermediate damper for coupling the upper end portions of the right and left dampers through a bifurcate link body which is rotatably supported by the vehicle body (for example, refer to JP-Tokukaisyo-62-275488).

In the above structure, the conventional running toy can obtain higher buffer effect due to the long stroke that is the total of the expansion strokes of the right and left dampers and the intermediate damper.

In the running toy, there is a case to prepare body covers with different designs for one vehicle body comprising wheels or a drive source to be changeable. In this case, there may be a case where the length of the wheel base is different depending upon the body covers, so that the position adjustment of the front wheels in the back and forth direction is performed.

However, in the above conventional shock-absorbing structure, a complicated structure is applied, in which the top and bottom dampers are coupled to the support shaft supporting the wheels, and are further coupled to the right and left dampers via the link body. Accordingly, in the conventional shock-absorbing structure, for responding to the position adjustment of the front wheels, reassembling becomes extremely complicated, thereby making it impossible to adjust the positions of the front wheels in practice.

SUMMARY OF THE INVENTION

The present invention has been achieved to solve the problem, and an object of the present invention is to enable a shock-absorbing structure of a wheel to easily respond to a position change of a running wheel in back and forth direction.

In accordance with the first aspect of the present invention, the running toy comprises:

a pair of right and left wheel supports to rotatably support right and left wheels, respectively;

a pair of right and left rotation support portions to rotatably support the right and left wheel supports around an axis line A along a back and forth direction as a center, respectively, the right and left rotation support portions being provided on both right and left side portions of a vehicle body, respectively; and a buffer to apply an elastic force to a portion of each of the wheel supports which is above the axis line of the rotation support portion, in a direction to react to the vehicle body, wherein each of the wheel supports supports the wheel on an outside of the axis line of the rotation support portion.

In the above running toy, each wheel support provided on the side portion of the vehicle body can rotate around the axis line along the back and forth direction of the vehicle body as a center, and supports the wheel on the outer side of the axis line of the rotation support portion (outer side of the vehicle body in the right and left direction), so that each wheel support rotates around the axis line thereof as a center by the weight of the running toy when the wheels grounds, and the upper portion of each wheel support contacts the vehicle body side.

Also, since the buffer is interposed between the upper portion of the wheel support and the vehicle body, each wheel is pushed back to the ground side by the elastic force of the buffer through the wheel support, thus enabling to obtain buffer effect to the vehicle body.

As described above, the structure is such that the buffer is arranged to be sandwiched between the upper portion of each wheel support and vehicle body, so that the buffer can carry out its function only by attaching it to at least one of the wheel support side and the vehicle body side, which is different from the conventional shock-absorbing structure in which a damper or a link body is coupled to each part. Thus, even when the front wheels are moved and adjusted, the buffer can easily respond without a need to do complicated reassembling work of the buffer.

Accordingly, the structure is such that the buffer is arranged to be sandwiched between the upper portion of each wheel support and vehicle body, so that buffer effect can be given to each wheel by the elastic force generated between each wheel support and the vehicle body by attaching it to at least one of the wheel support side and the vehicle body side. Thus, even when the front wheels are moved and adjusted, the buffer can easily respond without a need to do complicated reassembling work of the buffer, which is different from the conventional shock-absorbing structure in which a damper or a link body is coupled to each part.

Thereby, various body covers with different wheel bases can be mounted on the vehicle body, so that a user can enjoy running the running toy having body covers with different designs, thereby improving amusement of the running toy.

Further, as described above, in the case where the right and left wheels are supported by the wheel supports supported to be rotatable around the axis lines along the back and forth direction as a center in the right and left sides of the vehicle body, respectively, the grounded right and left wheels are inclined each other to be a truncated chevron shaped when viewed from the front.

Accordingly, especially, in the case of applying the above supporting structure of the wheels to the steering wheels, the right and left wheels can be maintained in a straight ahead state when not applying an outer force such as steering operation or the like. Thus, the running stability can be improved.

Preferably, the buffer is provided on the vehicle body to be movable and adjustable along the back and forth direction.

In the above running toy, when the position adjustment of the wheels in the back and forth direction with respect to the vehicle body is performed, the position adjustment of the buffer is performed in the back and forth direction with respect to the vehicle body to correspond thereto.

Accordingly, because the buffer is supported to be allowed to perform the position adjustment in the back and forth direction of the vehicle body side, even when the position adjustment of the wheels in the back and forth direction is performed, the position adjustment of the buffer can be completed only by the operation of sliding the buffer to correspond thereto. Thus, the position adjustment work of the buffer accompanying the position change of the wheels can be simple, and performed in a shorter time.

Preferably, the buffer comprises a long elastic body which is provided on the vehicle body along the back and forth direction.

In the above running toy, even when the position adjustment of the wheels in the back and forth direction with respect to the vehicle body is performed, since the buffer is formed to be long in the back and forth direction, the upper portion of each wheel support and a portion of the-buffer can still face each other. Consequently, the wheels can be pushed back to the ground side by the elastic force of the buffer via the wheel support, thereby enabling to obtain buffer effect.

Accordingly, since the buffer is the long elastic body provided on the vehicle body along the back and forth direction, buffer effect to the wheels can be maintained without performing the adjustment work of the buffer, when the adjustment work of the wheels in the back and forth direction is performed within the range of the length of the buffer. Thus, the position adjustment work of the buffer accompanying the position change of the wheels can be omitted or significantly simplified, and performed in a shorter time.

Preferably, the buffer comprises a plurality of elastic bodies provided on the vehicle body to be arranged along the back and forth direction.

In the above running toy, even when the position adjustment of the wheels in the back and forth direction with respect to the vehicle body is performed, since the plurality of buffers are arranged on the vehicle body in the back and forth direction, even when the adjustment work of the wheels in the back and forth direction with respect to the vehicle body is performed, the upper portion of each wheel support faces other buffer. Consequently, the wheels can be pushed back to the ground side by the elastic force of the buffers via the wheel supports, thereby enabling to obtain buffer effect.

Accordingly, since the plurality of buffers are provided on the vehicle body along the back and forth direction, buffer effect to the wheels can be maintained without performing the adjustment work of the buffers in the case where the adjustment work of the wheels in the back and forth direction is performed within the range of the length of the buffers. Thus, the position adjustment work of the buffers accompanying the position change of the wheels can be omitted or significantly simplified, and performed in a shorter time.

Preferably, the buffer is provided on each of the wheel supports.

In the above running toy, even when the position adjustment of the wheels in the back and forth direction with respect to the vehicle body is performed, since the buffer is provided on the wheel support, the upper portion of each wheel support contacts the vehicle body via the buffer. Consequently, the wheels can be pushed back to the ground side by the elastic force of the buffer via the wheel supports, thereby enabling to obtain buffer effect.

Accordingly, because the buffer is provided on the rotation support portion, when the adjustment work of the wheels in the back and forth direction is performed, the wheels and the wheel supports move in the back and forth direction, and buffer effect to the wheels can be maintained without performing the position change of the buffer. Thus, the position adjustment work of the buffer accompanying the position change of the wheels can be omitted or significantly simplified, and performed in a shorter time.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS (Whole Structure of the Embodiment of the Present Invention)

Figure 1:
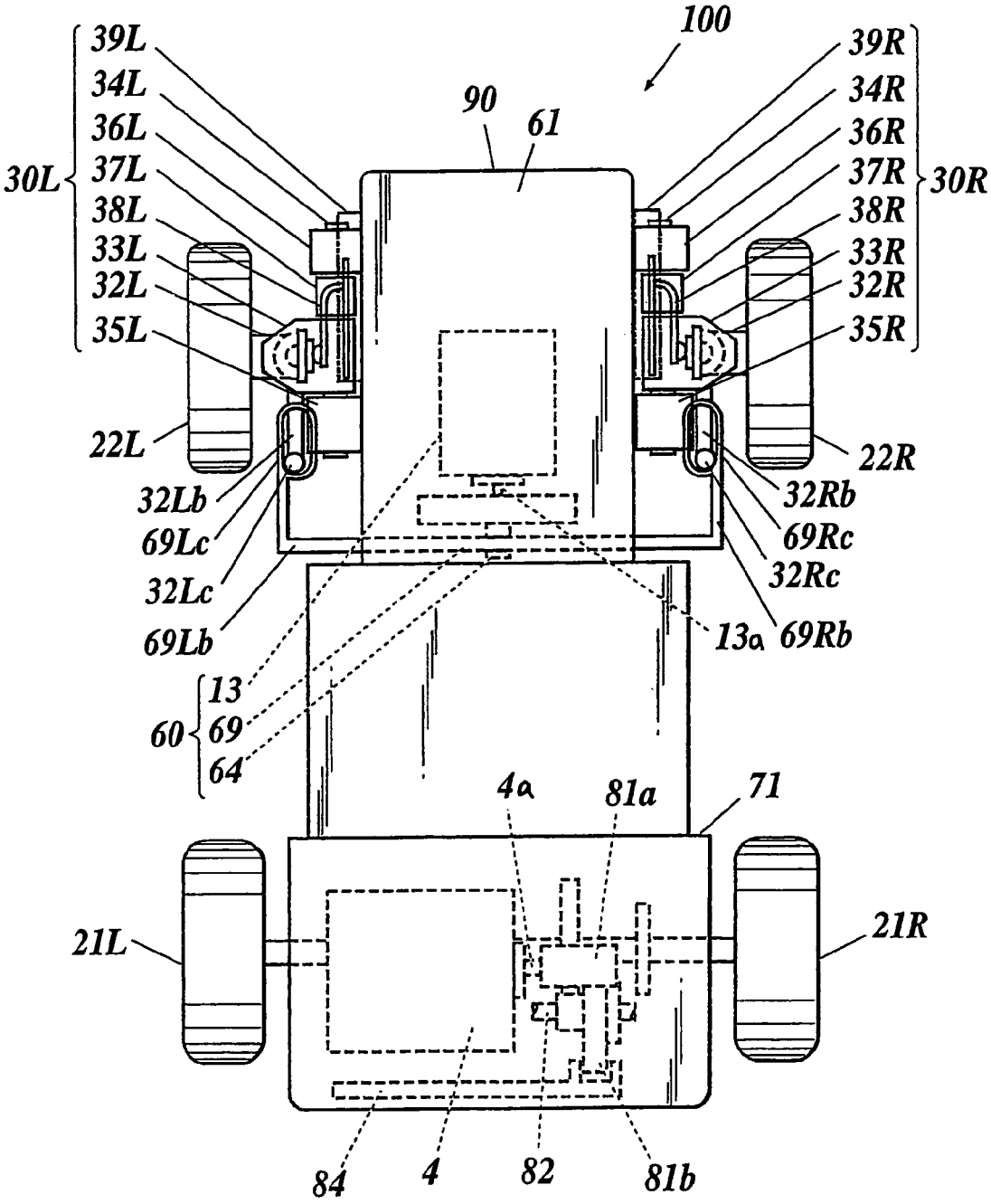
FIG. 1 is a plan view showing a straight ahead state of a running toy according to the embodiment of the present invention.
Figure 2:
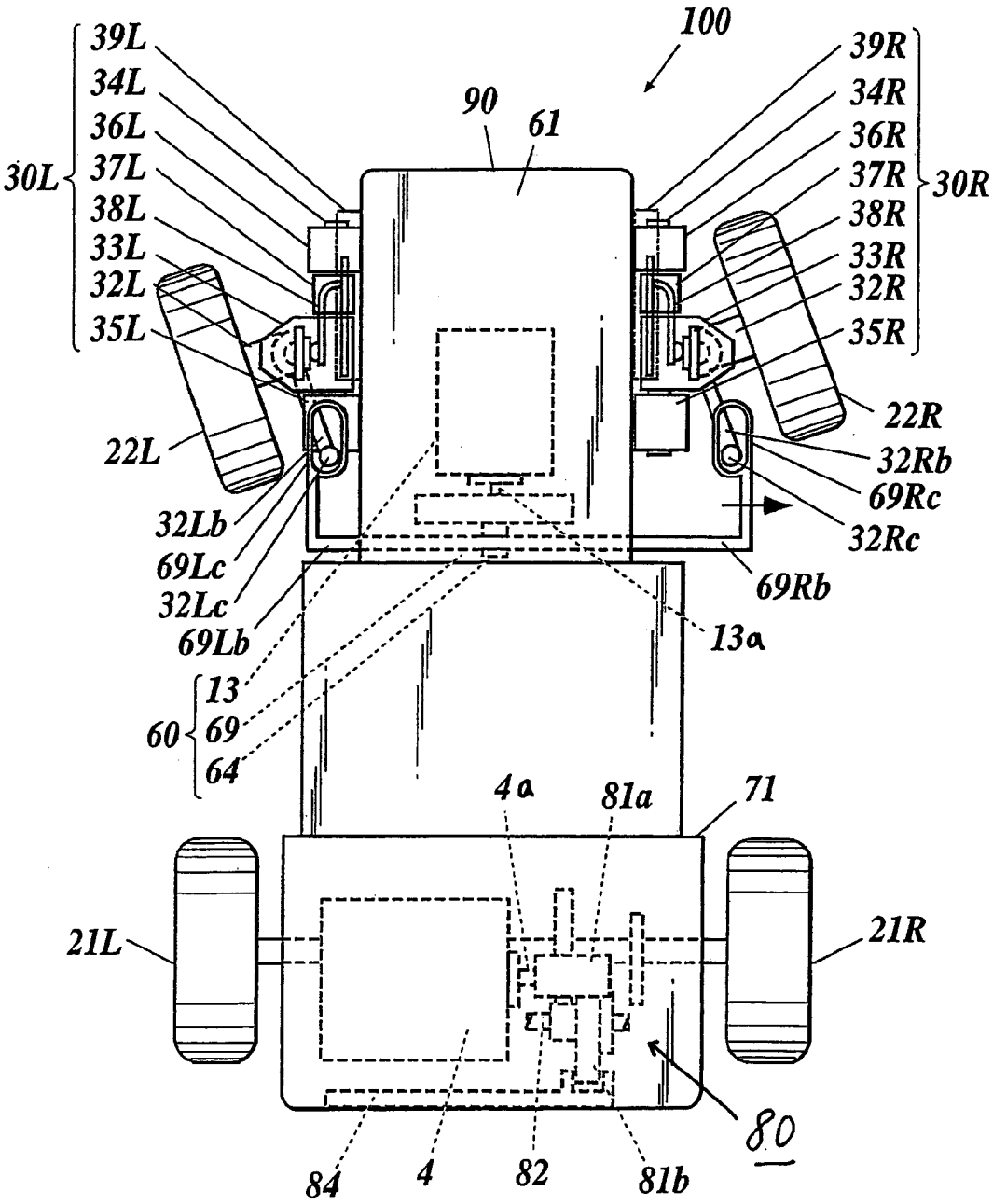
FIG. 2 is a plan view showing a left turn state of the running toy according to the embodiment of the present invention.
Figure 3:
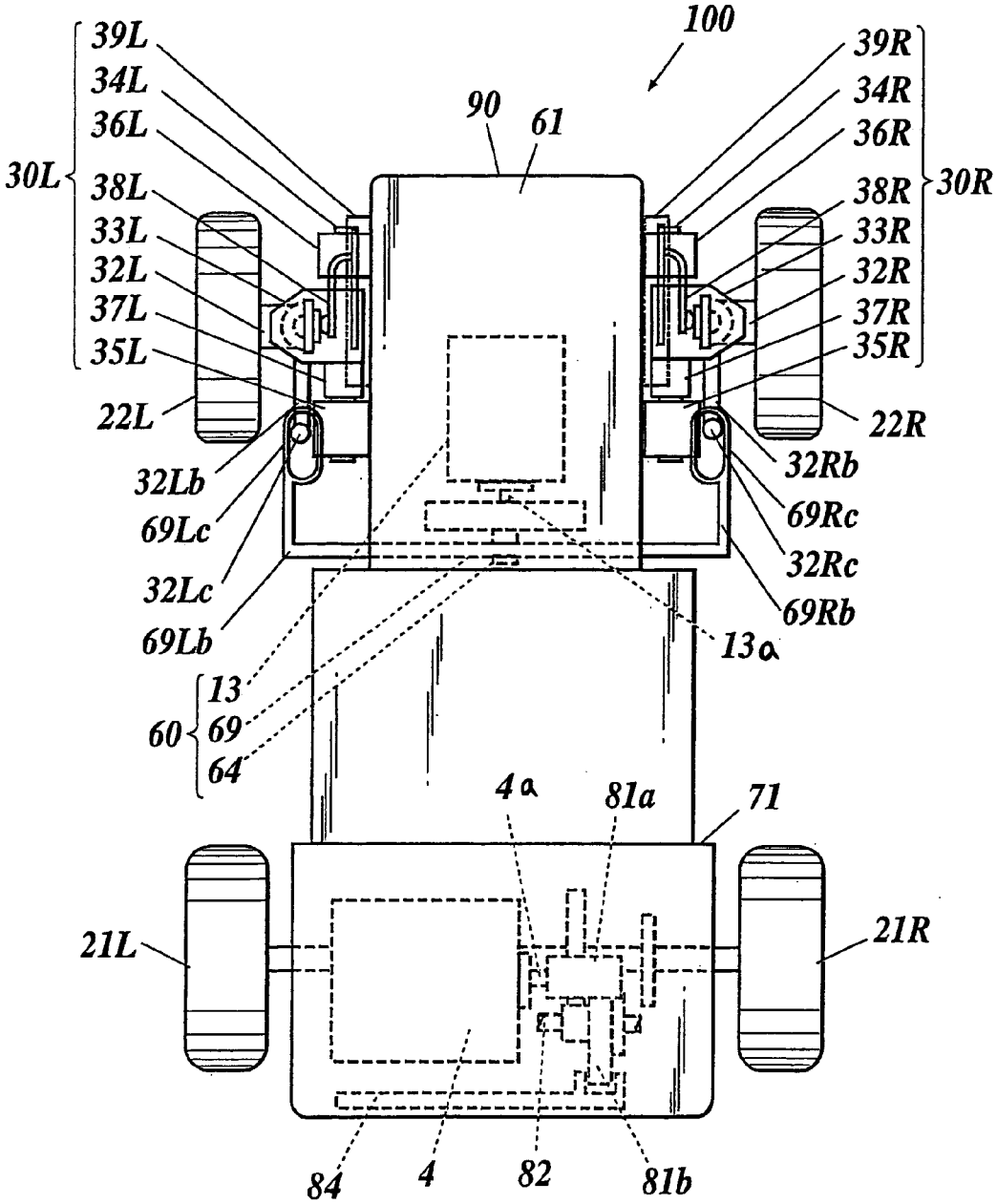
FIG. 3 is a plan view showing a state where steering wheels of the running toy according to the embodiment of the present invention were moved forward and adjusted.

FIGS. 1 to 3 are plan views of a running toy 100 of the embodiment of the present invention, wherein FIG. 1 shows a straight ahead state, FIG. 2 shows a left turn state, and FIG. 3 shows a state where steering wheels are moved forward and adjusted. In the explanation below, a back and forth direction of the running toy to go straight ahead is defined as a Y axis direction, a right and left direction is defined as an X axis direction, and a vertical direction is defined as a Z axis direction. These are at right angles with one another.

As shown in FIGS. 1 to 3, the running toy 100 comprises right and left rear wheels 21R, 21L as a drive wheel, right and left front wheels 22R, 22L as a steering wheel, front wheel support mechanisms 30R, 30L to support the front wheels 22R, 22L, respectively, a steering mechanism 60 to perform steering of each of the front wheels 22R, 22L, a running mechanism 80 to give running torque to each of the rear wheels 21R, 21L, a motor drive circuit to drive a direct current motor for running 4 as a drive source of the running mechanism 80 and a direct current motor for steering 13 as a drive source of the steering mechanism 60, a control circuit of the motor drive circuit, and a vehicle body 90 to store and hold each of the above components.

(Front Wheel Support Mechanism)

Figure 4:
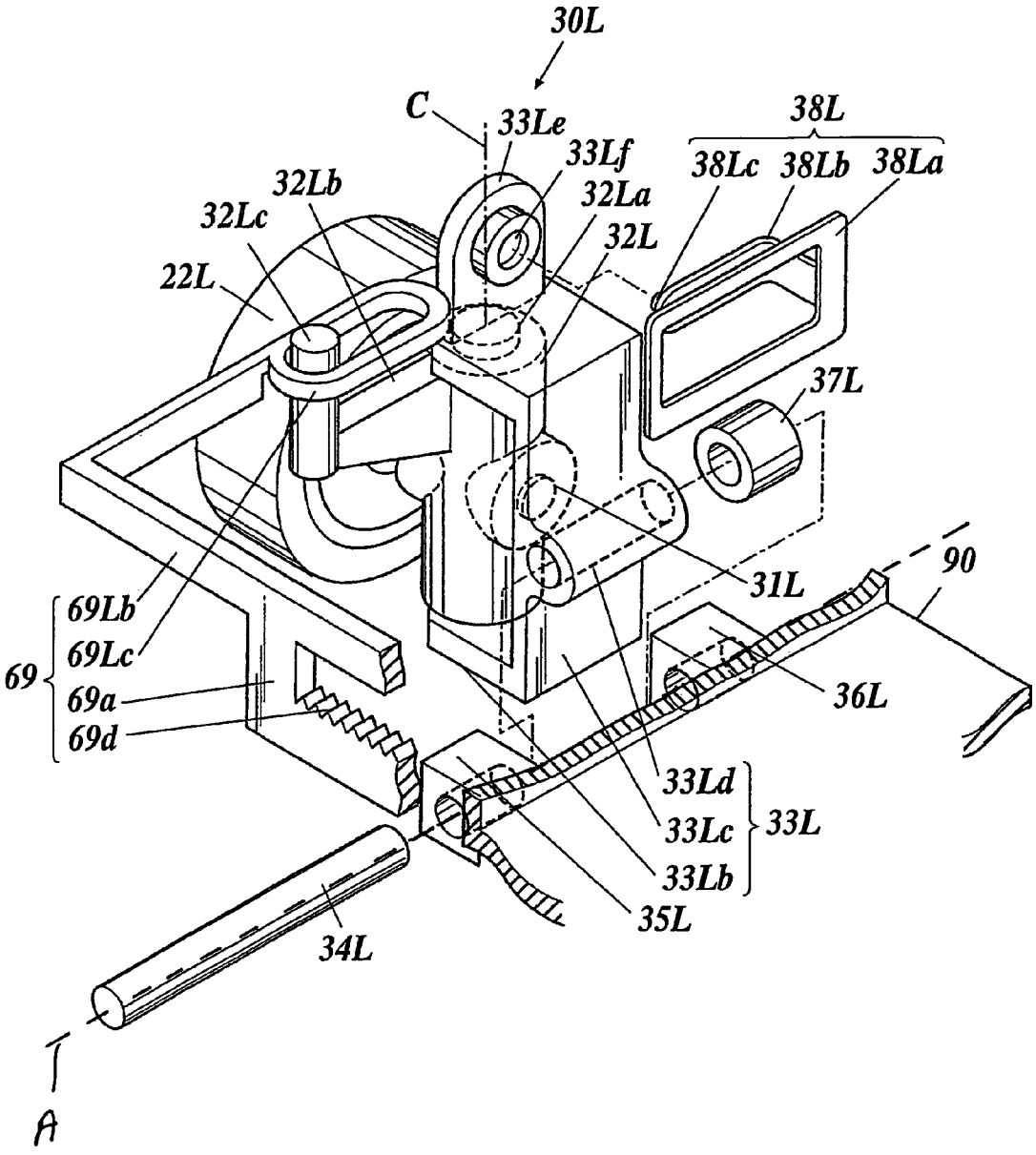
FIG. 4 is a broken perspective view of a front wheel support mechanism to support a left front wheel.

FIG. 4 is a broken perspective view of the front wheel support mechanism 30L to support the left front wheel 22L. The front wheel support mechanism 30L will be explained based on FIGS. 1 to 4. The front wheel support mechanism 30R of the right front wheel 22R is arranged to have mirror symmetry of the front wheel support mechanism 30L with respect to a Y-Z plane, so that the explanation thereof is omitted here. Each structure of the front wheel support mechanism 30R corresponding to that of the front wheel support mechanism 30L to be explained below is appropriately described by changing "L" of the reference numeral of each structure of the front wheel support mechanism 30L to "R". The front wheel support mechanisms 30R, 30L are provided at the right and left side surfaces of the vehicle body 90, respectively.

The front wheel support mechanism 30L comprises a steering rotating body 32L to rotatably support the front wheel 22L through a rotary shaft 31L, a wheel support 33L to rotatably support the steering rotating body 32L around a direction perpendicular to the rotary shaft 31L as a center, rotation support portions 35L, 36L to pivotally support the wheel support 33L by a support shaft 34L at the lower portion of the left side surface of the vehicle body 90, a spacer 37L to hold the wheel support 33L to a predetermined position along the support shaft 34L, a suspension member 38L as a buffer to absorb vibration to the vehicle body 90 from the front wheel 22L, and a suspension holding portion 39L to hold the suspension member 38L at the vehicle body 90 side.

The above front wheel 22L is rotatable around the rotary shaft 31L positioned at the center thereof, and the rotary shaft 31L is held by the steering rotating body 32L.

The steering rotating body 32L has an approximately cylindrical shape, and holds the rotary shaft 31L to be perpendicular to a center line C direction (vertical direction in FIG. 4) at the middle in the center line C direction of the cylinder. A round shaped projection 32La projecting along the center line C direction is formed on each of the both end portions of the steering rotating body 32L in the center line C direction (the projection at the lower side is not shown), and the steering rotating body 32L is supported by the wheel support 33L via the round shaped projections 32La. Each projection 32La has a round shape, so that the steering rotating body 32L can rotate around the center line C direction as a center with respect to the wheel support 33L.

Further, the steering rotating body 32L comprises a driven arm portion 32Lb which extends in a radial direction of the cylinder at the upper end portion thereof. A round bar like engaging protrusion 32Lc is provided to be fixed at the tip portion of the driven arm portion 32Lb to be parallel to the center line C direction. The engaging protrusion 32Lc is pressed by a steering arm 69 of the steering mechanism 60 to be described later in either direction along the X axis direction when steering. Thereby, the steering rotating body 32L is rotated with respect to the wheel support 33L, and the running direction of the front wheel 22L is changed, so that the steering of the running toy 100 is performed. The steering arm 69 is adapted to perform steering of the right and left steering rotating bodies 32R, 32L at the same time in the same direction with the same displacement.

The steering arm 69 of the steering mechanism 60 will be explained beforehand. The steering arm 69 comprises a slide flat portion 69*a* which is supported by a guide groove (not shown) provided in the vehicle body 90 to perform a reciprocating movement along the X axis direction, driving arms 69Rb, 69Lb each of which extends in a longitudinal direction from one of the both ends of the slide flat portion 69*a* in the longitudinal direction and bends perpendicularly in the middle, and ring-shaped portions 69Rc, 69Lc each having a long hole provided at the tip portion of each of the driving arms 69Rb, 69Lb.

The slide flat portion 69*a* has a long plate-like shape, and is supported by the not shown guide groove of the vehicle body 90 to be slidably movable in the X axis direction in a state where the flat plate surface thereof is parallel to the X-Z plane.

The slide flat portion 69*a* is provided with a long hole in the middle of the flat plate surface along the longitudinal direction, and a rack tooth 69*d* is formed along the longitudinal direction at the edge of the lower side of the long hole. The rack tooth 69*d* meshes a pinion gear 64 driven to rotate by the DC motor for steering 13 through a clutch mechanism 63, so that the steering arm 69 is moved in either direction along the X axis direction by converting motor torque to the power to move forward.

Each of the driving arms 69Rb, 69Lb is provided to extend in the longitudinal direction from one of the both end portions of the slide flat portion 69*a*, and bends in the middle in a direction perpendicular to the longitudinal direction. The bending direction is a direction which is perpendicular to the flat plate surface of the slide flat portion 69*a*. That is, when the slide flat portion 69*a* of the steering arm 69 is supported by the vehicle body 90 in a state to be along the X-Z plane, each of the driving arms 69Rb, 69Lb becomes a state where the tip portion thereof is along the Y axis direction.

Each of the ring-shaped portions 69Rc, 69Lc has a long hole along the tip portion of each of the driving arms 69Rb, 69Lb. That is, when the slide flat portion 69*a* of the steering arm 69 is supported by the vehicle body 90 in a state to be along the X-Z plane, each long hole of the ring-shaped portions 69Rc, 69Lc becomes a state where the tip portion thereof is along the Y axis direction. Each of the engaging protrusions 32Rc, 32Lc of the steering rotating bodies 32R, 32L is inserted into the long hole of each of the ring-shaped portions 69Rc, 69Lc. Each of the engaging protrusions 32Rc, 32Lc may incline in the X axis direction (to be described later), so that the width of the long hole of each of the ring-shaped portions 69Rc, 69Lc in the short axis direction is set to be slightly larger than the diameter of the engaging protrusions 32Rc, 32Lc. The positions of the front wheels 22R, 22L, and the steering rotating bodies 32R, 32L can be adjusted along the Y axis direction together with the wheel supports 33R, 33L (to be described later), so that the length of the long hole of each of the ring-shaped portions 69Rc, 69Lc in the long axis direction is set so that the amount of the position adjustment in the Y axis direction can be covered (refer to FIG. 3).

FIG. 2 shows a state where steering is performed by the steering arm 69. The steering arm 69 is moved in either direction in the X axis direction by the DC motor for steering 13, thus the steering rotating bodies 32R, 32L are rotated via the driven arm portions 32Rb, 32Lb from the driving arms 69Rb, 69Lb, respectively, thereby steering the front wheels 22R, 22L in the same direction. For example, when the steering arm 69 is moved to right, the front wheel 22R, 22L are steered to turn left, and when the steering arm 69 is moved to left, the front wheels 22R, 22L are steered to turn right. A return spring (not shown) to return to the straight ahead position to direct the front wheels 22R, 22L to the straight ahead direction, and a control knob (not shown) to control the straight ahead position returned by the return spring are both provided at the steering arm 69 in the vehicle body. Thus, when the steering control to the DC motor for steering 13 is released, it is possible to automatically return to the straight ahead running state.

Next, the wheel support 33L will be explained. The wheel support 33L supports the steering rotating body 32L to be rotatable around the center line C direction as a center. The wheel support 33L comprises a top plate 33La and a bottom plate 33Lb facing the both end portions of the steering rotating body 32L in the C direction, and a long back plate 33Lc connecting the top plate 33La and the bottom plate 33Lb, which are integrally formed to have an approximately C shape as a whole. That is, the top plate 33La and the bottom plate 33Lb are provided to extend in the same direction which is perpendicular to the back plate 33Lc. Each of the top plate 33La and the bottom plate 33Lb is provided with a receiving hole (not shown) to receive the projection 32La provided on each of the both ends of the steering rotating body 32L, so that the wheel support 33L supports the steering rotating body 32L to be rotatable.

There is provided an engaging hole 33Ld into which the support shaft 34L is inserted along a direction parallel to the flat plate surface thereof and perpendicular to the longitudinal direction, at the middle position in the longitudinal direction of the surface of the back plate 33Lc which is opposite side of the top plate 33La and the bottom plate 33Lb. That is, the wheel support 33L, the steering rotating body 32L and the front wheel 22L can rotate around the support shaft 34L which is inserted into the engaging hole 33Ld as a center with respect to the vehicle body 90.

Both end portions of the support shaft 34L are held by the two rotation support portions 35L, 36L which are fixed to be arranged in parallel along the Y axis direction with a predetermined space therebetween, at the lower portion of the left side surface. Accordingly, the wheel support 33L is arranged along the Y axis direction and is supported by the support shaft 34L to be rotatable around this direction as a center with respect to the vehicle body 90.

The space between the two rotation support portions 35L, 36L is set to be larger than the width of the wheel support 33L in the Y axis direction, and the cylindrical spacer 37L is inserted in the clearance.

FIG. 1 shows a state where the spacer 37L is arranged on the front side of the wheel support 33L, and FIG. 3 shows a state where the spacer 37L is arranged on the back side of the wheel support 33L.

The support shaft 34L functions as a guide to move the wheel support 33L along the Y axis direction, so that the position adjustment of the wheel support 33L in the Y axis direction can be made.

The spacer 37L can selectively be arranged on either the front side or the back side of the wheel support 33L to function as a holding section to hold the wheel support 33L at the adjustment position in the Y axis direction. That is, by changing the arrangement of the spacer 37L, the position of the wheel support 33L in the Y axis direction can be adjusted within the range between the rotation support portions 35L, 36L.

As above, the arrangement of each of the wheel supports 33R, 33L can be changed, so that even if wheel base is different when attaching various types of vehicle body covers with various designs to the vehicle body 90, the arrangement of front wheels 22R, 22L can be appropriately adjusted.

With regard to the spacer 37L, in addition to changing the arrangement thereof, a plurality of the spacers with different thickness may be prepared to adjust the position of the wheel supports 33R, 33L and the front wheels 22R, 22L in the Y axis direction by arranging the spacers on back and front sides of the wheel supports 33R, 33L, or laminating and arranging a plurality of thinner spacers on back and front sides of the wheel supports 33R, 33L.

The peripheries of the engaging hole 33Ld of the wheel support 33L and the hole in the spacer 37L are continuously connected, however, a part of the periphery of the hole may be cut to have a C shape in cross section, and the wheel support 33L and the spacer 37L may be made of material with flexibility. Thus, the wheel support 33L and the spacer 37L can be easily attached to the support shaft 34L which has already been attached to the rotation support portions 35L, 36L by pressing the C shaped cut portion therein.

A facing plate 33Le is integrally provided to stand on the upper surface of the top plate 33La of the wheel support 33L to be parallel to the flat plate surface of the back plate 33Lc. The facing plate 33Le is adapted to receive an elastic force in the reacting direction with respect to the vehicle body 90 from the suspension member 38L supported on the left side surface of the vehicle body 90. On the facing plate 33Le, a recess portion 33Lf with round shape to freely engage the semispherical projecting portion 38Lc provided on the suspension member 38L is formed on the facing surface of the vehicle body 90 side.

Figure 5:
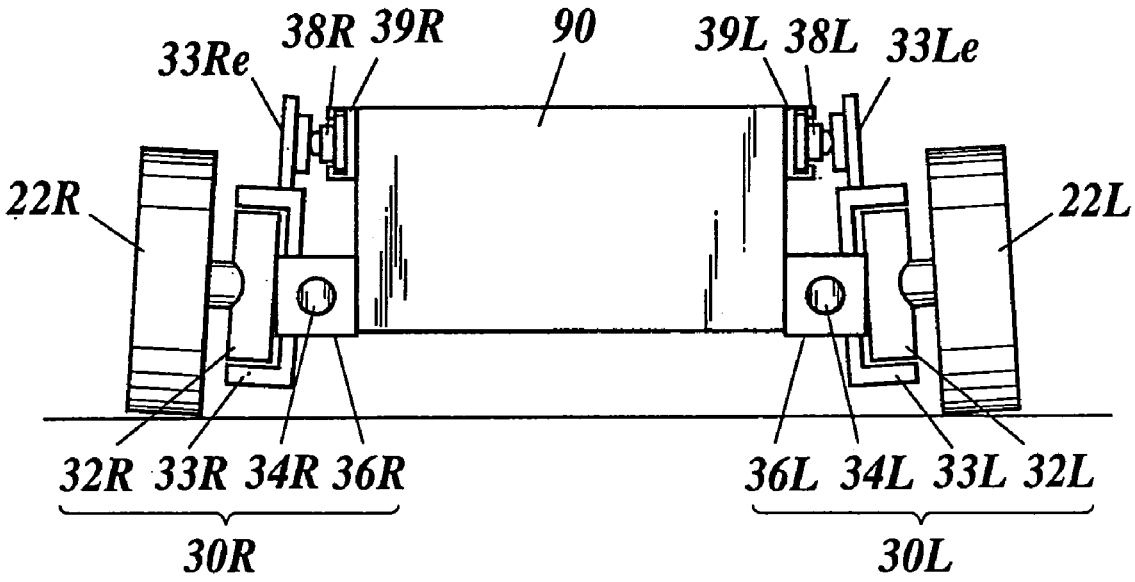
FIG. 5 is a front view of the running toy.
Figure 6:
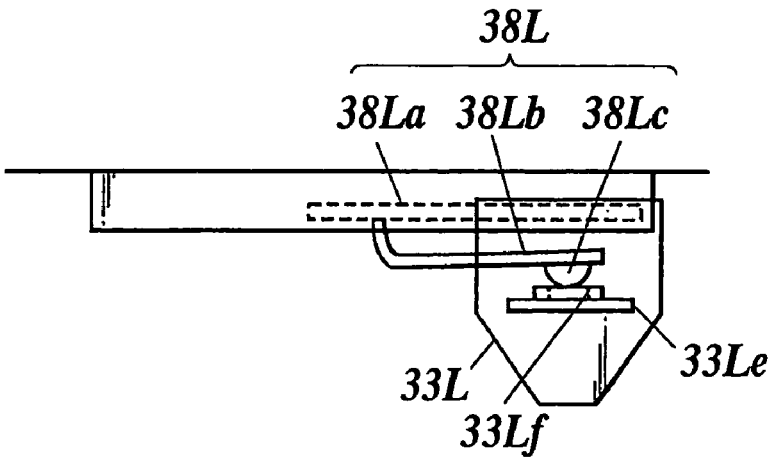
FIG. 6 is a plan view of a main portion showing an engagement state of a suspension member and a wheel support.
Figure 7:
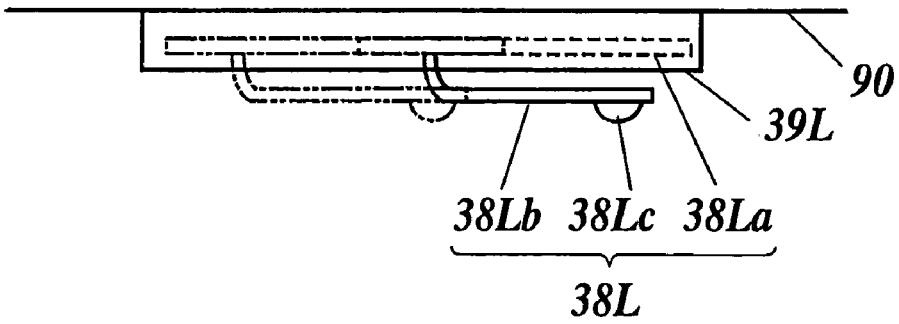
FIG. 7 is an explanation view showing a position adjustment of the suspension member.

FIG. 5 is a front view of the running toy 100, and FIGS. 6 and 7 are plan views of a main portion of the suspension member 38L.

The suspension member 38L comprises a rectangular plate like base portion 38La supported by the suspension holding portion 39L, a plate spring 38Lb which is made of elastic material and extends along the Y axis direction from the base portion 38La in a cantilevered state, and the semispherical projecting portion 38Lc provided at the extending tip portion side of the plate spring 38Lb. The suspension member 38L gives the elastic force to the wheel support 33L in a state where the projecting portion 38Lc of the suspension member 38L engages the round shaped recess portion 33Lf provided at the facing plate 33Le.

As shown in FIG. 5, when each of the front wheels 22R, 22L contacts the ground, the upper portions of the wheel supports 33R, 33L rotate in a direction to come close to the side surface of the vehicle body 90 around the support shafts 34R, 34L as a center by the weight of the running toy 100, respectively, because the front wheels 22R, 22L are positioned on the outer side of the support shafts 34R, 34L in the width direction of the vehicle body 90 (X axis direction), respectively.

Thus, the front wheels 22R, 22L, and the wheel supports 33R, 33L become the state of inclining to be a truncated chevron shaped when viewed from the front. Therefore, the facing plates 33Re, 33Le provided on the upper side of the wheel supports 33R, 33L move to a direction to come close to the side surface of the vehicle body 90. However, since the suspension members 38R, 38L which cause a reaction force in a direction to separate from the side surfaces are provided on the side surfaces of the vehicle body 90, the wheel supports 33R, 33L are pushed back by the elastic force of the suspension members 38R, 38L through the facing plates 33Re, 33Le. Thereby, the vibration which the front wheels 22R, 22L receives from the ground can be reduced by the suspension members 38R, 38L to obtain buffer effect while maintaining a state where the right and left front wheels 22R, 22L are inclined to each other to be the truncated chevron shaped.

The front wheels 22R, 22L as a steering wheel maintain the inclined state to widen downward, so that the straight ahead steering state can be maintained when an external force is not given (steering operation by the steering mechanism 60 is not performed).

As described above, the position adjustment of the wheel supports 33R, 33L can be performed in the back and forth direction with respect to the vehicle body 90. Therefore, the position adjustment of the suspension members 38R, 38L also need to be performed in the back and forth direction with respect to the vehicle body 90. Accordingly, as shown in FIGS. 5 and 7, the suspension holding portion 39L (same in the 39R) supports the long base portion of the suspension member 38L to be slidable along the Y axis direction. Thereby, the suspension member 38L is moved to be adjusted in the same way as the recess portion 33Lf provided in the facing plate 33Le of the wheel support 33L which was moved in the Y axis direction and adjusted, and the projecting portion 38Lc thereof can engage the recess portion 33Lf. Thus, even when the position adjustment of the front wheels 22R, 22L in the back and forth direction was performed, it is possible to maintain a certain buffer effect.

As described above, in the front wheel support mechanisms 30R, 30L, the suspension members 38R, 38L are provided on the side surface sides of the vehicle body 90 to face the facing plates 33Re, 33Le provided on the upper portion of the wheel supports 33R, 33L, respectively. Thus, the elastic reaction force acts in the state where the front wheels 22R, 22L, and the wheel supports 33R, 33L that are pivotally supported around the Y axis direction as a center are inclined to widen downward to be a truncated chevron shaped, so that vibration or impact to the vehicle body 90 caused due to the road surface condition can be reduced.

In the front wheel support mechanisms 30R, 30L, the wheel supports 33R 33L are pivotally supported by the support shafts 34R, 34L and are slidable with respect to the support shafts 34R, 34L, respectively, so that the positions of the wheel supports 33R, 33L are decided by the spacers 37R and 37L. Thus, the adjustment of the wheel base can be performed only by a minor change of a part of the structure, which is different from the structure to extend or shorten the whole vehicle body. Accordingly, the structure of adjustment can be simple, and the adjustment work can be performed easily and in a shorter time.

Further, the structure is such that the adjustment of the wheel supports 33R, 33L in the back and forth direction is performed by separating them from the vehicle body, and also they are members mainly for supporting only the front wheels 22R, 22L, and the steering rotating bodies 32R, 32L, so that the size thereof can be small, and there is no need to consider the arrangements of various components stored in the vehicle body and impairing the function thereof as a conventional one when moving and adjusting the wheel supports 33R, 33L, enabling to adjust the wheel base with simple structure.

Since reduction in size and weight of the wheel supports 33R, 33L is easy, distortion due to the lack of strength is hard to occur, thus favorable running condition can be maintained.

Further, such as the ring-shaped portions 69Rc, 69Lc comprising the long hole, the steering arm 69 of the steering mechanism 60 comprises the structure in which locomotive faculty can be transmitted in the right and left direction even if change of the positions of the steering rotating bodies 32R, 32L in the back and forth direction occur, so that the position adjustment of the front wheels 22R, 22L in the back and forth direction is not interrupted, and steering can be stably performed.

The suspension members 38R, 38L are supported by the suspension holding portions 39R, 39L to be movable in the back and forth direction to adjust the positions, so that the elastic force can be given to the direction to separate from the vehicle body 90 even when the change of the positions of the wheel supports 33R, 33L in the back and forth direction occurs. Thus, stable buffer effect can be obtained irrespective of the adjustment of the position of the front wheels 22R, 22L in the back and forth direction.

Further, even when the front wheels 22R, 22L are moved and adjusted, it can easily be dealt with only by the sliding operation without a need to do complicated reassembling work of the suspension members 38R, 38L, enabling to perform the work easily and in a shorter time.

(Modified Example of Front Wheel Support Mechanism) In the above steering mechanism 60, the structure is such that the rack tooth is formed on the steering arm 69, and the steering arm 69 is moved in the X axis direction by the pinion gear 64 which is driven to rotate by the DC motor for steering 13, however, it is not limited thereto. Any method to give locomotive faculty to the steering arm 69 when necessary may be applied. For example, a structure in which an electromagnet and a magnetic material or a permanent magnet are used such as a solenoid or a linear motor, or a structure in which an arm is provided on an output shaft of a rotary motor in the radial direction and the steering arm 69 is moved from side to side by the rotation of the arm may be applied.

The engagement of the steering arm 69 and the steering rotating bodies 32R, 32L is made by coupling the ring-shaped portions 69Rc, 69Lc each having the long hole and the engaging protrusions 32Rc, 32Lc, however, any structure may be applied as long as they move in conjunction with each other in the X axis direction while allowing the relative movement occurring between them in the Y axis direction. For example, the long hole and the round bar like protrusion may be provided in the opposite positions, or a groove may be used instead of the long hole. A slider to move along the extending direction of the driving arm or the driven arm may be provided to one of them, and the other thereof may be connected to the slider to be rotatable around the Z axis direction as a center.

The front wheel support mechanisms 30L, 30R are not limited to the above structure, and any structure in which movement to adjust in the Y axis direction is possible while allowing the rotation needed for steering the front wheels 22R, 22L may be applied. For example, the rotation support portions 35L, 36L may be provided to be movable along the Y axis direction with respect to the vehicle body 90 to make the wheel support 33L movable along the Y axis direction together with the support shaft 34L. The rotation support portions 35L, 36L may have a relief structure such as a boss and a fitting hole to be attachable to or detachable from the vehicle body 90, and the position adjustment of the rotation support portions 35L, 36L may be performed by providing a plurality of recess portions or projecting portions on the side surface side of vehicle body along the Y axis direction. Moreover, at least two or more C rings may be coaxially fixed to the wheel support 33L, the support shaft 34L having a diameter larger than that of the C ring may be provided on the rotation support portions 35L, 36L, and a plurality of circumferential grooves to rotatably attach the C ring along the longitudinal direction of the support shaft 34L may be formed on the outer periphery of the support shaft 34L. In this case, by selecting the circumferential grooves for the C rings and attaching the wheel support 33L, the position adjustment of the wheel support 33L in the Y axis direction can be achieved.

The same modification can be applied to the front wheel support mechanism 30R.

Although the suspension members 38R, 38L of the front wheel support mechanisms 30R, 30L can be moved and adjusted in the Y axis direction by the suspension holding portions 39R, 39L, any structure to elastically give buffer effect to the front wheels 22R, 22L irrespective of the change of position even when the position adjustment of the front wheels 22R, 22L in the back and forth direction was performed may be applied.

For example, the:suspension member may be a long elastic body fixed to the vehicle body 90 along the Y axis direction.

Further, a plurality of the suspension members may be fixed to the vehicle body 90 along the Y axis direction.

Further, the suspension member made of an elastic body contacting the side surface of the vehicle body 90 may be provided on each of the facing plates 33Le and 33Re of the wheel supports 33R, 33L.

In these cases, when the position adjustment of the front wheels 22R and 22L in the back and forth direction is performed, there is no need to do the position adjustment of the suspension members. The elastic force is given to the wheel supports 33R, 33L from the suspension members, so that buffer effect to the front wheel 22R, 22L can be maintained. In these cases, the suspension holding portions 39R, 39L can be eliminated.

(Steering Mechanism)

The vehicle body 90 comprises a motor and mechanism storing portion 61 in which a motor and mechanism storing room is provided. The DC motor for steering 13 is provided in the motor and mechanism storing room. A cover to cover the upper side of the motor and mechanism storing room is detachably attached to the vehicle body 90. The motor storing room and the mechanism storing room may be divided, and separate covers may be provided to cover the motor storing room and the mechanism storing room.

Figure 8A:
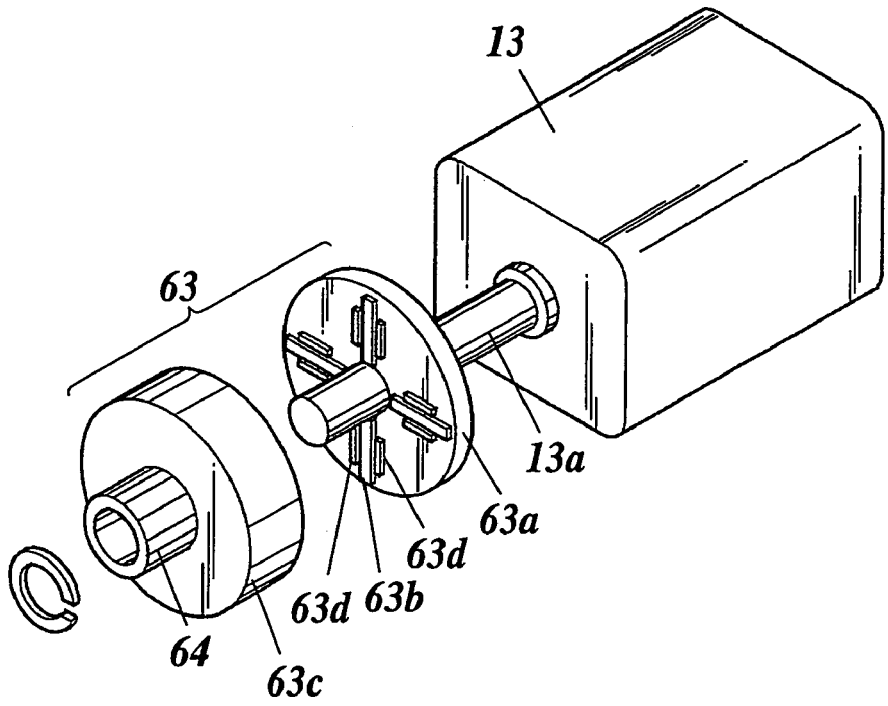
FIGS. 8A and 8B are explanation views showing a direct current motor for steering and a clutch mechanism.
Figure 8B:
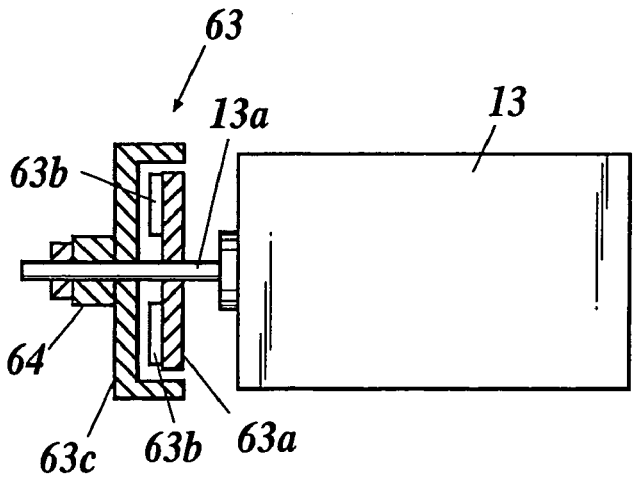

As the DC motor for steering 13, a motor which can perform normal rotation and reverse rotation (normal and reverse rotations) can be used. The DC motor for steering 13 is mounted in the motor and mechanism storing room so that a shaft 13*a* thereof projects backward of the vehicle body 90 from the motor case. As shown in FIGS. 8A and 8B, the shaft 13*a* is provided with the gear (pinion gear) 64 through the clutch mechanism 63. The clutch mechanism 63 comprises a disk (holding plate) 63*a*, clutch pieces 63*b* and an external cylinder 63*c*. That is, the disk 63*a* is fixed to the shaft 13*a*. The shape of this disk 63*a* is not specifically limited to the disk shape. The plurality of the clutch pieces 63*b* are provided on the end surface of the disk 63*a*. Each clutch piece 63*b* is attached to the disk 63*a* to be movable in the radial direction of the shaft 13*a*. That is, guides 63*d* approximately radially extending from the rotation center of the disk 63*a* are formed on the disk 63*a*, and each clutch piece 63*b* is movable in the radial direction of the shaft 13*a* along the guides 63*d*. Each guide 63*d* is formed so that at least the outer end side thereof is formed to have a bar shape. When the disk 63*a* rotates, each clutch piece 63*b* is adapted to move outward in the radial direction of the shaft 13*a* by a centrifugal force acting thereto.

On the other hand, the external cylinder 63*c* has a peripheral wall to surround the disk 63*a* and the guides 63*d* from the outside in the radial direction of the shaft 13*a*. When the disk 63*a* is rotated by the power of the DC motor for steering 13, each clutch piece 63*b* is moved outward in the radial direction of the shaft 13*a* by the centrifugal force acting on thereon. Thus, each clutch piece 63*b* is pressed to the inner surface of the peripheral wall of the external cylinder 63*c*, so that the disk 63*a* and the external cylinder 63*c* integrally rotate. In the state where the disk 63*a* is not rotated, the external cylinder 63*c* can rotate freely with respect to the disk 63*a*.

The pinion gear 64 meshes the rack tooth 69*d* formed on the steering arm 69. Consequently, when the pinion gear 64 is rotated in the normal or the reverse direction by the power of the DC motor for steering 13, the steering arm 69 moves from side to side corresponding to the rotation direction thereof.

In this embodiment, the steering arm 69 is operated by the DC motor for steering 13 via the gear mechanism, however, the steering arm 69 may be operated from side to side by an electromagnet. That is, one of a permanent magnet and a coil may be attached to the steering arm 69, and the other one may be attached to the fixed portion of the vehicle body 90 to control energization of the coil, thereby operating the steering arm 69 from side to side.

(Direct Current Motor for Running)

Figure 9:
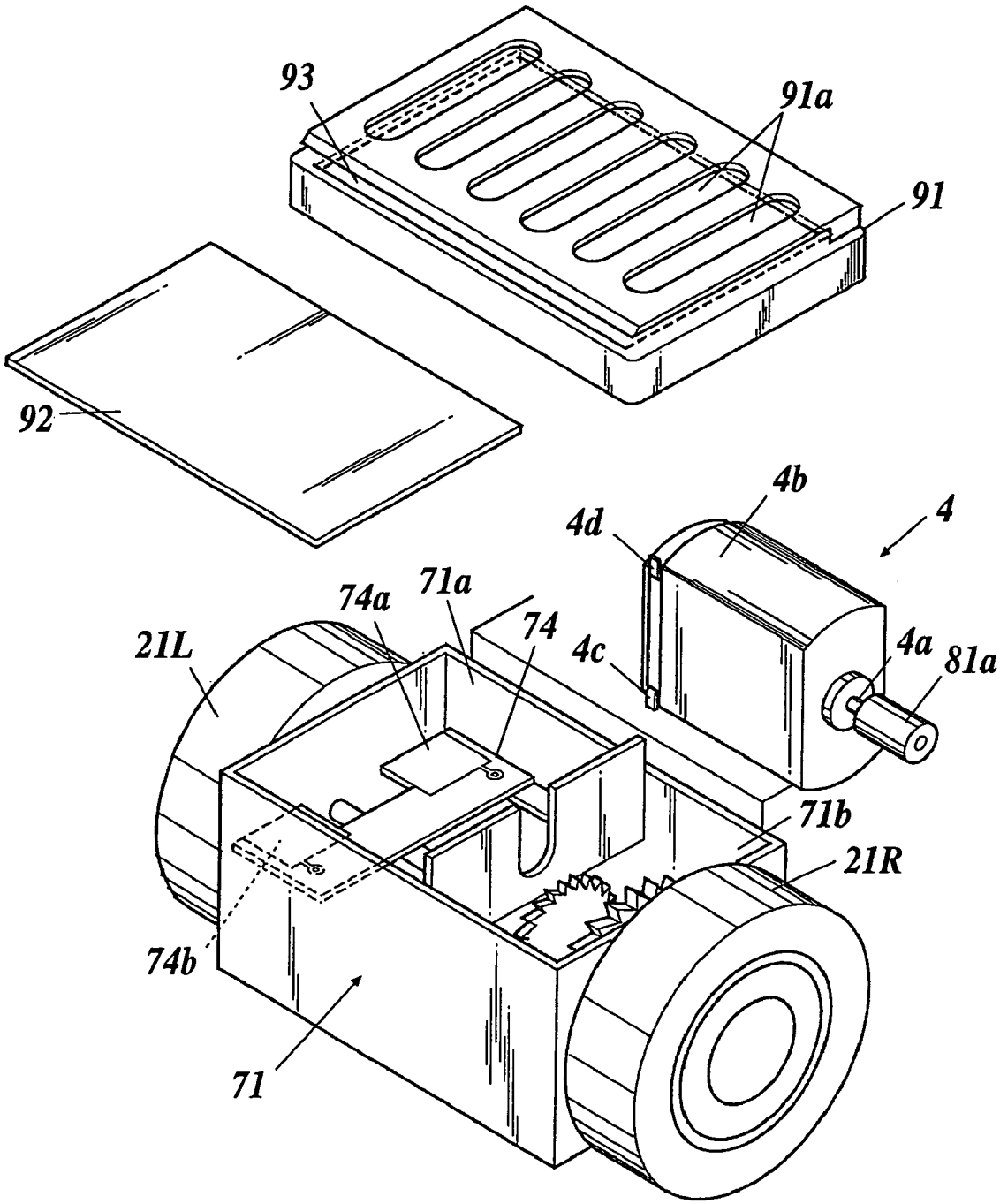
FIG. 9 is a perspective view showing a direct current motor for running and a running mechanism.
Figure 10:
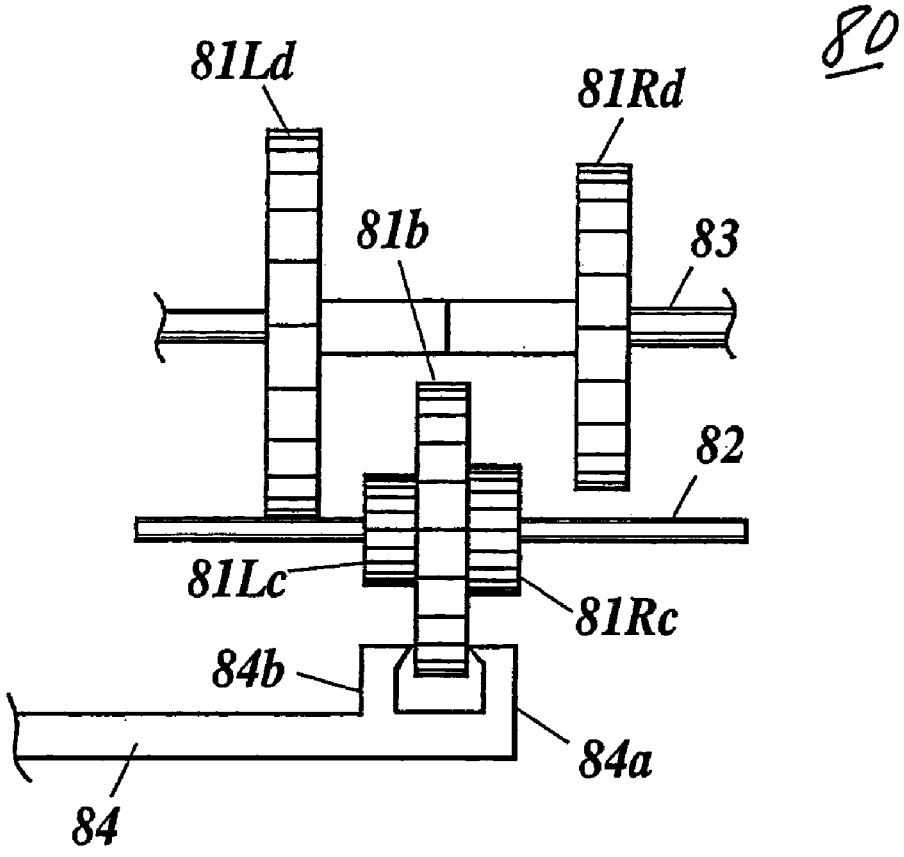
FIG. 10 is a plan view showing the running mechanism.

Provided at the rear portion of the vehicle body 90 is a motor and mechanism storing portion 71, the inside of which is divided into a motor storing room 71*a* and a mechanism storing room 71*b* as shown in FIG. 9.

As the DC motor for running 4, a motor which can perform normal rotation and reverse rotation (normal and reverse rotations) can be used. The DC motor for running 4 is mounted in the motor storing room 71*a* so that a shaft 4*a* thereof projects toward the width direction of the vehicle body 90 from a motor case 4*b*. The shaft 4*a* is provided with a gear (pinion gear) 81*a*. The gear 81*a* is provided at the position to be in the mechanism storing room 71*b* when the main body of the DC motor for running 4 is mounted in the motor storing room 71*a*. Two terminals 4*c*, 4*d* are provided on the outer periphery of the motor case 4*b* of the DC motor for running 4.

The floor of the motor storing room 71*a* is formed with a printed wiring board 74. Electrode patterns 74*a*, 74*b* are formed on the surface of the printed wiring board 74 to correspond to the terminals 4*c*, 4*d*. The electrode patterns 74*a*, 74*b* are formed by printing or vapor deposition.

When the DC motor for running 4 is mounted on the printed wiring board 74, the terminals 4*c*, 4*d* are electrically connected to the electrode patterns 74*a*, 74*b*, thereby supplying electricity to the DC motor for running 4.

The printed wiring board 74 may have a plate like shape, or may be curved to be concave upward. That is, it is only necessary that the printed wiring board 74 is formed to correspond to the shape of the motor case 4*b* and the terminals 4*c*, 4*d* to contact the electrode patterns 74*a*, 74*b*.

According to the running toy 100 having the above structure, since the printed wiring board 74 on which the electrode patterns 74*a*, 74*b* are formed is used, the assembly of the running toy 100 becomes extremely easy. That is, in the case of not using the printed wiring board 74, fine work such as assembling electrode plates (conductive plates) one by one on the vehicle body side, soldering of conducting wires for electrical connection or the like is needed. On the other hand, when using the printed wiring board 74 on which the electrode patterns 74*a*, 74*b* are formed, it is only necessary to assemble the printed wiring board 74 to the vehicle body when assembling the running toy 100, so that the assembly of the running toy 100 becomes extremely easy.

When electrically connecting the conducting wires in the case of using the conductive wires, there is a possibility to make a mistake in wiring, however, in this embodiment, there is no need to consider such mistake because the terminals are electrically connected only by contacting the electrode patterns 74*a*, 74*b*.

(Running Mechanism)

The running mechanism 80 for transmitting the running torque of the DC motor for running 4 to the rear wheels 21R, 21R is provided in the mechanism storing room 71*b*. The running mechanism 80 comprises a gear mechanism 81 having the gear 81*a*.

That is, a shaft 82 parallel to the shaft 4*a* extends in the mechanism storing room 71*b*. As shown in FIG. 1, a gear 81*b* is provided on the shaft 82 to be freely rotatable with respect to the shaft 82. The gear 81*b* can move in the axis direction of the shaft 82. Gears 81Rc, 81Lc are integrally provided on the shaft 82 on the right and left sides of the gear 81*b*.

A shaft (rear wheel axle) 83 parallel to the shaft 82 extends in the mechanism storing room 71*b*. Gears 81Rd, 81Ld are fixed to the shaft 83. When the gear 81*b* moves in the axis direction of the shaft 82, the gears 81Rc, 81Lc alternately mesh the gears 81Rd, 81Ld corresponding to the moving direction of the shaft 82. Specifically, when the gear 81*b* moves to the left in the axis direction of the shaft 82, the gear 81Lc meshes the gear 81Ld, and when the gear 81*b* moves to the right in the axis direction of the shaft 82, the gear 81Rc meshes the gear 81Rd. By changing the meshing state of the gears, the running torque can be changed.

For moving the gear 81*b* in the axis direction of the shaft 82, a not shown operation control is attached on the lower side of the vehicle body 90. A lever 84 is moved to left or right by the operation of the operation control, so that the gear 81*b* between pawls 84*a* and 84*b* of the lever 84 is pushed to left or right to change the meshing state of the gears.

(Cover)

As shown in FIG. 9, a cover 91 to cover the upper side of the motor storing room 71*a* and the mechanism storing room 71*b* is detachably attached to the vehicle body 90. The cover 91 functions as a motor holding member. Separate covers may be provided to separately cover the motor storing room 71*a* and the mechanism storing room 71*b* from the upper side.

The cover 91 is provided with a plurality of heat radiation openings 91*a* and a slit 93 to attach a radiation plate 92. The radiation plate 92 can be detached from the slit 93. For example, the radiation plate 92 is preferably made of metal such as copper or aluminum, however, it may be made of synthetic resin (for example, ABS resin) if selecting the shape with high radiation effect.

According to the running toy 100 having the above structure, the radiation plate 92 can be replaced easily, thereby enabling to easily change heat radiation performance. Moreover, the radiation plate 92 with different weights can be used depending upon the road surface condition. Further, the radiation plate 92 with different colors or shapes can be used according to mood. To effectively exert above various effects, it is preferable to prepare a plurality of radiator plates which are different in any of heat radiation property, weight, color and shape, and select a radiation plate among them to suit the need.

The number of the radiation plates 92 to be attached at the same time is not limited to one. The structure may be such that two or more radiation plates 92 can be attached to the cover 91.

(Drive Circuit and Control Circuit)

The DC motor for running and the DC motor for steering are mounted on the running toy, and the rotation direction of each motor is changed by remote control, that is by sending radio waves from a remote control device.

Figure 11:
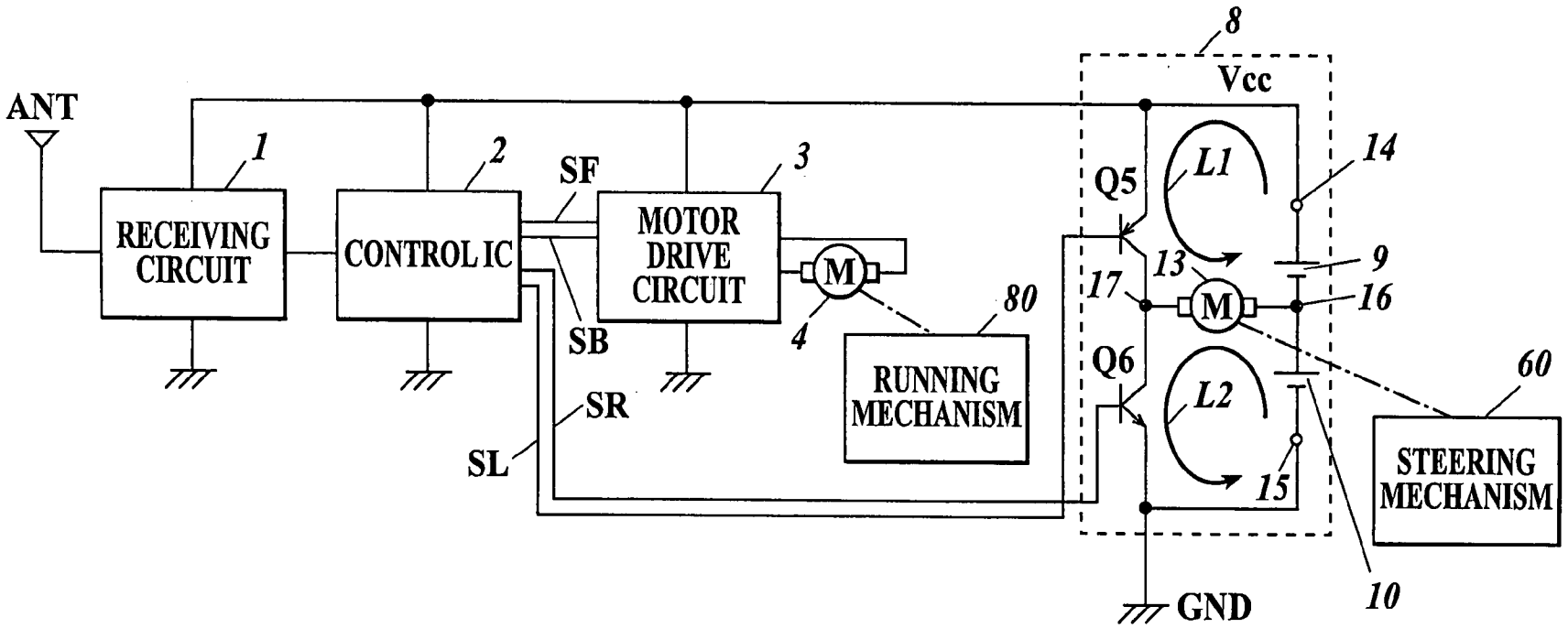
FIG. 11 is a circuit diagram showing a drive circuit.

As shown in FIG. 11, a receiving circuit 1, a control IC 2, a running motor drive circuit 3 for driving the DC motor for running 4, and a steering motor drive circuit 8 for driving the DC motor for steering 13 are contained in the running toy.

An operation signal radio wave transmitted from the not shown remote control device is received by the receiving circuit 1 through the antenna and demodulated to be input to the control IC 2. The control IC 2 transmits a control instruction signal corresponding to the operation signal which was input to the control drive circuit of the running system and/or the steering system.

For example, when the operation signal is the forward movement instruction, the control IC 2 outputs the forward movement instruction signal SF to the running motor drive circuit 3. The running motor drive circuit 3 supplies voltage having a polarity corresponding to the forward movement direction to the DC motor for running 4. Similarly, when the operation signal is the backward movement instruction, the control IC 2 outputs the backward movement instruction signal SB to the running motor drive circuit 3. The running motor drive circuit 3 supplies voltage having a polarity corresponding to the backward movement direction to the DC motor for running 4.

When the operation signal is the steering control signal for the right turn instruction, the control IC 2 outputs the right turn instruction signal SR to the steering motor drive circuit 8. The steering motor drive circuit 8 supplies voltage having a polarity corresponding to the right turn direction to the steering motor drive circuit 8. Similarly, when the operation signal is the left turn instruction, the control IC 2 outputs the left turn instruction signal SL to the steering motor drive circuit 8. The steering motor drive circuit 8 supplies voltage having a polarity corresponding to the left turn direction to the DC motor for steering 13.

The steering motor drive circuit 8 comprises a positive power supply terminal 14 and a negative power supply terminal 15 between which at least two batteries 9, 10 can be connected in series.

A PNP transistor (first switching element) Q5 and a NPN transistor (second switching element) Q6 are connected in series between the positive power supply terminal 14 to supply power supply voltage Vcc and the negative power supply terminal 15 connected to the GND potential. The transistor Q5 and the transistor Q6 become conducting (ON) and nonconducting (OFF) alternately according to the left turn instruction signal SL and the right turn instruction signal SR from the control IC 2.

The DC motor for steering 13 is connected between a junction point 16 of the batteries 9, 10 and a junction point 17 of the transistor Q5 and the transistor Q6.

The rotary shaft of the DC motor for steering 13 is connected to the steering mechanism 60 connected to the steering wheels (front wheels). By changing the rotation direction of the. DC motor for steering 13, the direction of the steering wheels can be changed through the steering mechanism 60.

Figure 12:
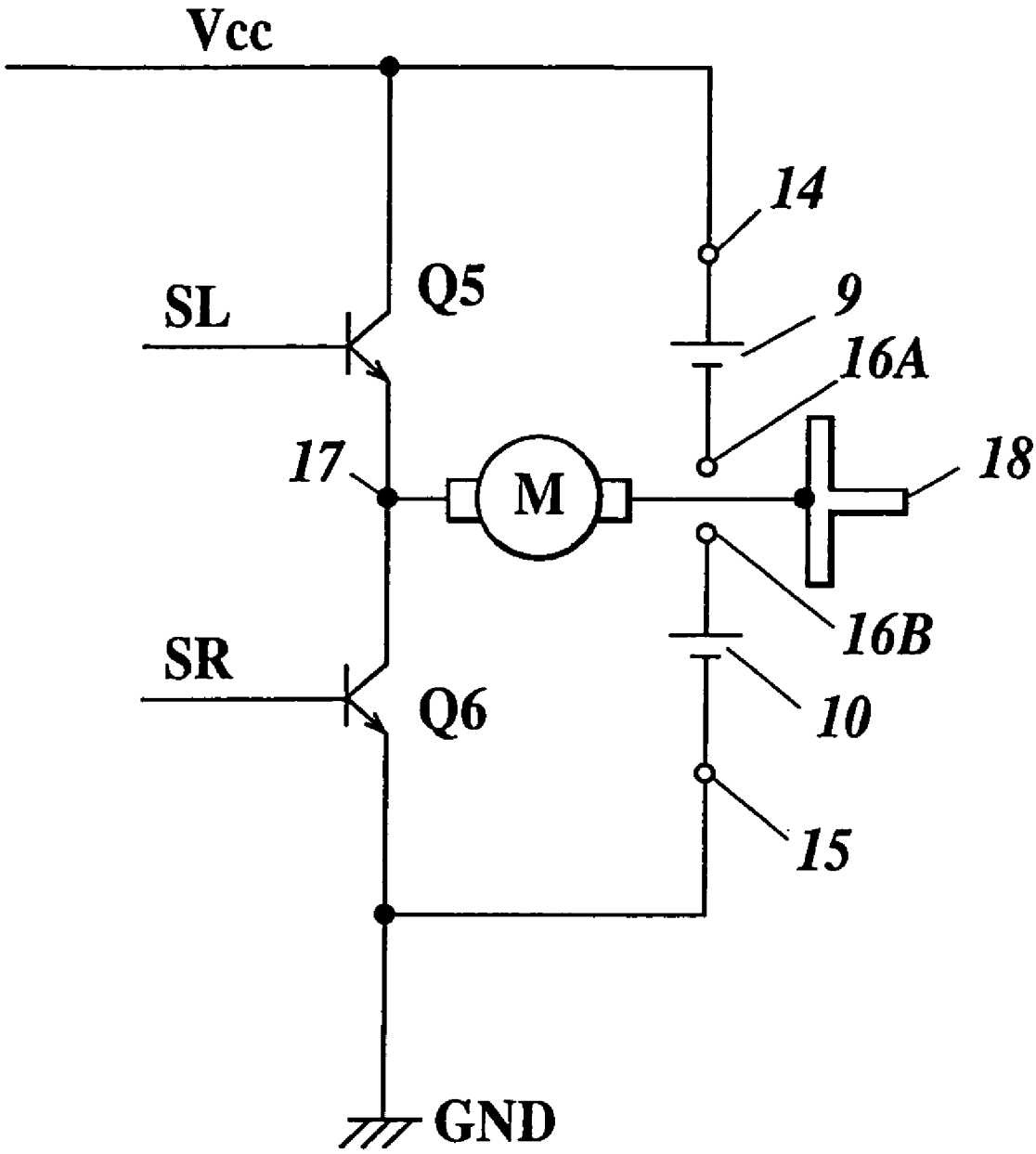
FIG. 12 is a circuit diagram showing a power switch.

As shown in FIG. 12, a self-holding type power supply switch 18 is provided at the junction point of the batteries 9, 10. The power supply switch 18 is for electrically connecting a terminal on one side of the DC motor for steering 13, a negative side terminal 16A of the battery 9, and a positive side terminal 16B of the battery 10 when the power is on.

When the power supply switch 18 is on, the negative side of the battery 9 and the positive side of the battery 10 are electrically connected, and one terminal of the DC motor for steering 13 is connected to the power supply switch 18, so that the power supply voltage Vcc of the two series-connected batteries (for example, 1.5V×2=3V) is supplied to each circuit 1, 2, 3, 8, and a current path of an armature of the DC motor for steering 13 is formed.

Although the power supply voltage Vcc (for example, 3V) is applied between both ends of the steering motor drive circuit 8, the voltage applied to the DC motor for steering 13 in each rotation direction thereof is ½ of the power supply voltage Vcc (1.5V) because the battery to be used is different depending upon a loop L1 and a loop L2 to be described later.

(Circuit Operation)

When the power supply switch 18 (FIG. 12) is on, the batteries 9, 10 are connected in series via the negative side terminal 16A and the positive side terminal 16B, and the DC motor for steering 13 is connected to the junction point 16 (FIG. 11) of the batteries 9, 10. At this time, two loops are formed in the steering motor drive circuit 8.

As shown in FIG. 11, one is the loop L1, that is, battery 9⇒positive power supply terminal 14⇒transistor Q5⇒junction point 17⇒DC motor for steering 13⇒junction point 16⇒battery 9.

Another one is the loop L2, that is, battery 10⇒junction point 16⇒DC motor for steering 13⇒junction point 17⇒transistor Q6⇒negative power supply terminal 15⇒battery 10.

Now, when the left turn instruction signal SL "potential L" is applied from the control IC 2, the transistor Q5 is on, the current flows in the path of the loop L1, and the DC motor for steering 13 rotates to left corresponding to the current direction thereof. On the other hand, when the right turn instruction signal SR "potential H" is applied from the control IC 2, the transistor Q6 is on, the current flows in the path of the loop L2 which is reverse direction in the case of the loop L1, and the DC motor for steering 13 rotates to right corresponding to the current direction thereof.

As above, the transistors Q5 and Q6 alternately perform ON/OFF operation in a complementary style. With the ON/OFF operation, the direction of the armature current flowing in the DC motor for steering 13 is revered to control the running direction of the running toy.

When running a plurality of the running toys 100 at the same time, the operating frequency to operate each running toy 100 is made different. In this case, it is needed to select and supply a remote controller which accords with each operating frequency of the running toy side. Therefore, to make the selection of a pair of the running toy 100 and the corresponding remote controller easy, it is preferable to change the color of the conductive wire for antenna depending upon the operating frequency.

The entire disclosure of Japanese Patent Application No. Tokugan 2004-299102 which was filed on Oct. 13, 2004, including specification, claims, drawings and summary are incorporated herein by reference in its entirety.

What is claimed is:

1. A running toy comprising:

a vehicle body with a pair of right and left side surfaces having upper and lower portions, a back and a front;

a pair of right and left support shafts extending along a back to front direction along the lower portions of the side surfaces of the vehicle body, a pair of right and left wheel supports which are rotatably supported on the right and left support shafts respectively, to rotatably support right and left wheels outside the support shafts and movable along the shafts along the back to front direction; and a buffer provided on each upper portion of the right and left side surfaces of the vehicle body, to apply an elastic force to upper portions of the right and left wheel supports.

2. The running toy s claimed in claim 1, wherein the buffer is provided on the vehicle body to be movable and adjustable along the back to front direction.

3. The running toy as claimed in claim 1, wherein the buffer comprises a long elastic body which is provided on the vehicle body along the back to front direction.

4. The running toy as claimed in claim 1, wherein the buffer comprises a plurality of elastic bodies provided on the vehicle body to be arranged along the back to front direction.

5. The running toy as claimed in claim 1, wherein the buffer is provided on each of the wheel supports.

6. The running toy as claimed in claim 1, wherein each of the right and left support shafts is rotatably supported by a plurality of rotation support members arranged along the back to front direction with a predetermined spacing, each of the rotation support members being attached to the lower portion of the side surface of the vehicle body, and having a through hole in which one of the support shafts is rotatable.

7. The running toy as claimed in claim 6, further comprising: a spacer member held on each of the support shafts between the plurality of rotation support members, for holding each of the wheel supports at a predetermined position on each of the support shafts.

8. The running toy as claimed in claim 7, wherein each of the wheel supports is held at a desired position along the back to front direction on each of the support shafts, depending on a position where the spacer member is held on each of the support shafts.

9. The running toy as claimed in claim 1, wherein the buffers apply an elastic force to the wheel supports in a direction substantially perpendicular to the side surfaces of the vehicle.

10. The running toy as claimed in claim 2, wherein each of the buffers comprises a suspension holding member provided on each of the side surfaces of the vehicle body, which extends along the back to front direction, and a plate like spring member slidably held by the suspension holding member.

11. The running toy as claimed in claim 7, wherein the spacer member comprises a plurality of spacers, each of which is disposed at a predetermined position on each of the support shafts, to hold each of the wheel supports at a predetermined position on each of the support shafts.

* * * * *